United States Patent [19]

Kuwica

[11] Patent Number: 4,949,446

[45] Date of Patent: Aug. 21, 1990

[54] RIVET REMOVER

[76] Inventor: Daniel Kuwica, Unit 5 - 3009 Murray St., Port Moody, Canada, V3H 1Y3

[21] Appl. No.: 385,025

[22] Filed: Jul. 25, 1989

[51] Int. Cl.[5] ..... B25B 1/24

[52] U.S. Cl. ..... 29/243.53; 269/102

[58] Field of Search ..... 29/243.53, 243.54, 257, 29/243.55, 283.5, 522, 509; 264/102; 59/7, 11; 72/965, 966, 391, 396, 453.19, 453.15, 453.16, 312, 313

[56] References Cited

U.S. PATENT DOCUMENTS

| | | | |
|---|---|---|---|
| 3,233,402 | 2/1966 | Urbaitis | 29/257 |
| 4,109,900 | 8/1978 | Vandecoevering | 269/102 |
| 4,248,412 | 2/1981 | DeRoy | 269/102 |
| 4,365,401 | 12/1982 | Ogren | 29/243.53 |

FOREIGN PATENT DOCUMENTS

| | | | |
|---|---|---|---|
| 2084502 | 4/1982 | United Kingdom | 29/257 |

*Primary Examiner*—Robert C. Watson

*Attorney, Agent, or Firm*—Townsend & Townsend

[57] ABSTRACT

An apparatus to remove a rivet from a chain saw chain. The apparatus includes a body with a recess in the body. A partially threaded opening is formed at one end of the body and extends to the recess. An anvil can be located in the recess. There is a slot in the anvil of predetermined width to contact a saw chain of predetermined pitch. A bolt is received in the partially threaded opening and a punch member is received in the opening. The punch member abuts the bolt to extend to the recess. Thus, tightening of the bolt extends the punch into the recess and the punch can thus be driven to break the head of a rivet in a saw chain. Preferably the apparatus includes a spinner to allow forming of a rivet in a saw chain. The apparatus is easy to use, easy to transport and, in particular, can be used easily on the job site.

16 Claims, 1 Drawing Sheet

RIVET REMOVER

FIELD OF THE INVENTION

This invention relates to an apparatus to remove a rivet from a chain saw chain.

DESCRIPTION OF THE PRIOR ART

A chain saw is the standard method of felling trees in modern logging. It comprises a sharpened chain, driven by a motor and located on a guide bar. The chain is in fact a structure of some complexity but, for the purpose of the present invention, may simply be considered to be a plurality of flat, sharpened bodies which include drive links, side links and left and right hand cutters, each riveted to neighbouring links.

Logging is frequently carried out in remote locations. Thus, when a saw chain breaks it is desirable for the logger to be able to repair the chain at the work site. A professional logger's chain saw is a substantial machine and it is not normally practical to carry two chain saws for each logger. Instead it is usual for the logger to maintain the chain saw at the work site. If the chain breaks, and demands on the chain are extremely high, then the usual procedure is to replace the broken link. Typically the chain will break at a single link and typically that link will break across a rivet hole. It is necessary therefore to remove the two rivets that secure the broken link, put in a fresh link put in fresh rivets for the link and to spin those rivets, that is form the head on the rivet to locate the link in place. Filing the bottom of the new link may then be necessary to conform it to the size of the older links in the chain. It is inevitable that a logger will carry with him a 19 mm socket to replace the plug in the two stroke motor used in the chain saw. The plug socket is part of a combination wrench, the other end being a screwdriver for general maintenance on the chain saw.

It is known to provide equipment to an individual so that the chain saw may be maintained. Examples of prior art known to applicant include U.S. Pat. Nos. 3,233,402 to Urbatitis; 4,693,406 to Bartholomew et al; 3,412,597 to Rains; 3,234,634 to Johnson et al.

None of the above prior art shows the features of the present invention which, at least according to a preferred embodiment, include means not only to remove a rivet but a simple means of forming the rivet. The device of the present invention, unlike the above prior art, can be used with ease in the work place and can be used with a wide variety of chain saw chains.

SUMMARY OF THE INVENTION

Accordingly, the present invention, in its broadest aspect, is an apparatus to remove a rivet from a chain saw chain comprising a body, a recess in the body, an at least partially threaded opening at one end of the body extending to the recess, an anvil to be located in the recess, a slot in the anvil of predetermined width to contact a saw chain of predetermined pitch, a bolt to be received in the at least partially threaded opening, and a punch member to be received in the opening to abut the bolt to extend into the recess whereby tightening of the bolt extends the punch into the recess.

In a preferred aspect the apparatus includes a spinner to allow spinning, that is forming, of a rivet head into a chain saw chain. The spinner comprises a body to be received in the at least partially threaded opening having a concave end able to form a rivet head.

DESCRIPTION OF THE DRAWINGS

Aspects of the invention are illustrated, merely by way of example, in the accompanying drawings in which.

DESCRIPTION OF THE PREFERRED EMBODIMENTS

Figure 1:
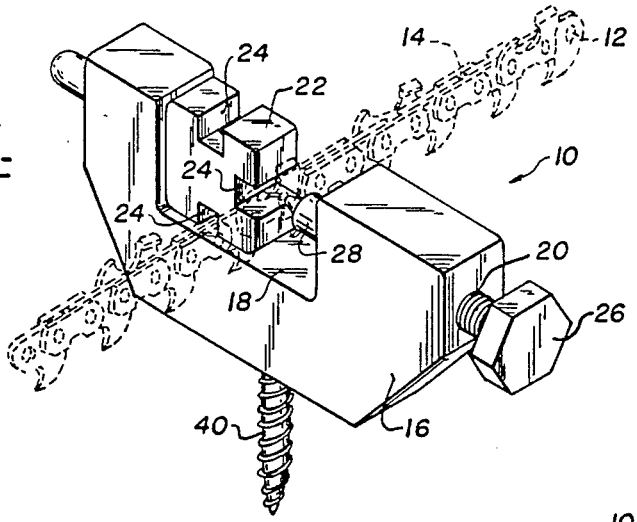
FIG. 1 is an isometric view of the apparatus according to the present invention.

The drawings show an apparatus 10 to remove a rivet 12 from one side of a chain saw chain 14, shown in broken lines in FIG. 1. The apparatus comprises a body 16 having a recess 18. As shown particularly in FIG. 2 there is a partially threaded opening 20 at one end of the body 16 extending through the body to the recess 18. An anvil 22 is located in the recess 18. In the illustrated embodiment there are a plurality of slots 24 in the anvil 22 each of a predetermined width to contact a chain of predetermined pitch, depending on the size and type of the saw. Thus, as an example, the slots 24 in the anvil 22 may be for chain pitches, 0.325 inch, $\frac{3}{8}$ inch and $\frac{1}{4}$ inch. The depth is generally immaterial.

There is a bolt 26 threaded to be received in the partially threaded opening 20. A punch member 28 is also received in the opening and is arranged to abut the bolt 26. Tightening of the bolt 26 pushes the punch member 28 into the recess 18.

Figure 2:
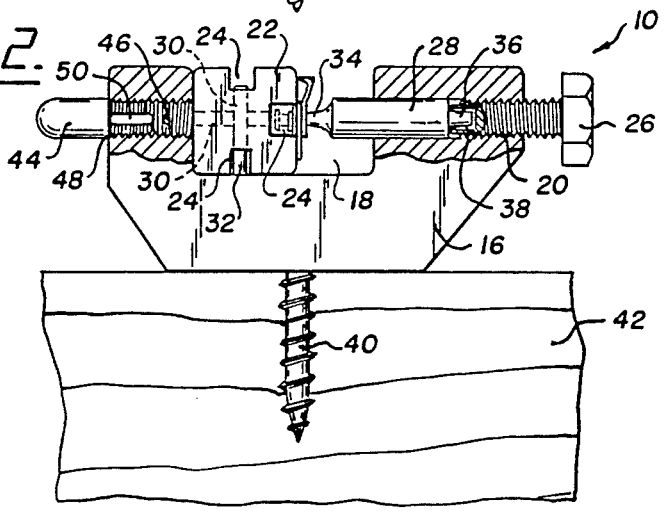
FIG. 2 is a side elevation of the apparatus, partially in section.
Figure 3:
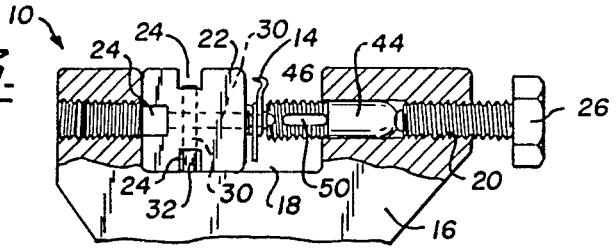
FIG. 3 is an elevational detail showing a second mode of operation of the apparatus.

In the preferred embodiment, the anvil 22 is located in the recess 18 by the provision of a pair of openings 30 extending through the anvil 22. These openings 30 engage a post 32 located in the recess 18 and thus locate the anvil 22. The preferred arrangement, as shown particularly in FIGS. 2 and 3, is also to have the anvil 22 abutting a wall of the recess 18 so that force is applied against the wall, not merely against the post 32.

The punch member 28 comprises a body that is a relatively close fit within the partially threaded opening 20. The punch 20 has a narrow end to punch out a rivet 12. In the preferred embodiment shown in FIG. 2 the punch member 20 has two narrowed ends 34 and 36, each of different size to allow punching out of rivets of different sizes. As a result a recess 38 is provided in the bolt 26 to accommodate the narrowed end 34 or 36 of the punch member 28.

The apparatus 10 includes means to steady it during use. This means it comprises a lag bolt 40 extending from the body 16 so that it may be screwed in to a tree, tree stump or the like 42 at the logging work site.

In the illustrated preferred embodiment, the apparatus includes a spinner 44 to allow forming a head on a rivet of a chain saw chain. As shown in FIG. 2 and 3 the spinner 44 comprises a body that can be received in the partially threaded opening 20 and has a concave end 46, shown particularly in FIG. 2, able to form a rivet head. In order to store the spinner 44 the body 16 includes a second threaded opening 48 and the spinner 44 is provided with a threaded part to engage that opening 48. To allow rotation of the spinner 44 during its use in riveting the spinner body is provided with a slot 50 that can be engaged by an elongate member, for example, the screwdriver portion of a combination wrench.

To use the apparatus according to the present invention when a chain link breaks the chain is removed from the chain saw and brought to the apparatus located in stump 42. The bolt 26 is backed off and the punch member 28 pushed rearwardly, to the right in FIG. 2. The anvil 22 is removed from the post 32. The appropriate slot for the chain pitch is selected and the anvil is then repositioned on the post. The chain is positioned against the anvil with a side link within slot 24 and a drive link abutting the outer edges of slot 24 as shown most clearly in FIG. 2. The bolt 26 is tightened, using the spark plug socket of the combination wrench for the chain saw, to push the punch member 28 outwardly. The chain location is observed to ensure that the narrowed end 34 or 36 contacts the rivet 12 at the centre. When the narrowed end of the punch member 28 and the rivet 12 are appropriately aligned the bolt 26 is tightened to push the punch member 28 outwardly until the spun part of the rivet hed is destroyed and the rivet tip is forced out of the chain.

The bolt 26 is slackened, the punch member 28 moved backwardly into the opening 20 and the other rivet of the damaged tooth is then removed using the same technique. During the rivet removal the bolt 26 rotates but the punch member 28 only moves longitudinally; it does not rotate. As a result it is important that grease be inserted in the opening 20, between the bolt end and the punched member.

As is apparent from FIG. 2, the size of the punch can easily be varied simply by inserting the unwanted end into the opening 20. Similarly, the anvil 22 is extremely easy to reposition on post 32 so the appropriate opening is used for the damaged link.

The link is replaced by using a fresh link and fresh rivets. Typically, fresh links will be preset having one end of the rivet already formed onto the chain parts. These are available in small packages, easily carried in the pocket. To spin the new rivet, the new link, including the already formed rivets, are put in place and the rivets pushed through the aligned openings of the old and new links. In the apparatus 10 the anvil 22 is removed, the punch member 28 is removed and set to one side. The spinner 44 is removed from its storage position, shown in FIG. 2, and inserted in its useful position, shown in FIG. 3. The anvil 22 is repositioned on post 32 so that the side of anvil 22 without a slot 24 is positioned adjacent spinner 44. Opening 30 that extends to the side of anvil 22 without slot 24 is shaped at its outer end to receive and locate a preset rivet head in a preformed side link. To this end the outer end of the opening 30 may be beveled slightly. With the chain properly positioned, as shown in FIG. 3, bolt 26 is advanced so that the concave end 46 in the end of spinner 44 comes into contact with the unformed end of the rivet. The bolt 26 is tightened gently until concave end 46 rests against the rivet. Tightening of the bolt 26 is then stopped and a blade like member, typically the screwdriver of the combination wrench, is inserted into the slot 50 which is rotated to spin or form the head of the rivet. When the spinner 44 rotates easily, additional tension is applied by tightening the bolt 26 and the spinner 44 is then again spun using the screwdriver blade. This is continued until a rivet head is formed. The procedure is then repeated on the other rivet of the new link.

Thus, the apparatus of the present invention is compact, robust and easy to use. Not only does it provide a simple and efficient way of removing rivets from virtually all sizes of commercial chain saw chains but it also has means of reriveting a fresh link into position and all this is carried out in a matter of minutes on the job site.

I claim:

1. Apparatus to remove a rivet from a chain saw chain comprising:
- a body;
- a recess in the body;
- an at least partially threaded opening at one end of the body extending to the recess;
- an anvil to be located in the recess;
- a plurality of slots in the anvil, each slot of predetermined width to contact a saw chain of predetermined pitch;
- a bolt to be received in the at least partially threaded opening;
- a punch member to be received in the opening to abut the bolt to extend into the recess whereby tightening of the bolt extends the punch into the recess.

2. Apparatus as claimed in claim 1 in which there are three slots in the anvil.

3. Apparatus as claimed in claim 1 in which the anvil has a pair of openings extending through it;
- a post in the recess to engage an opening to locate the anvil.

4. Apparatus as claimed in claim 1 in which the punch member comprises a body to be received with a close fit within the at least partially threaded opening; and
- a narrowed end to act as the punch to punch out a rivet.

5. Apparatus as claimed in claim 4 in which the punch member has two narrowed ends of differing sizes to punch out rivets of different sizes; and
- a recess in the bolt to accommodate the narrowed ends of the punch member.

6. Apparatus as claimed in claim 1 including means to steady the apparatus during use.

7. Apparatus as claimed in claim 6 in which the means to steady the apparatus comprises a lag bolt extending from the body to be screwed into a tree stump or the like.

8. Apparatus as claimed in claim 1 including a spinner to allow forming of a rivet in a chain saw chain, the spinner comprising a body to be received in the at least partially threaded opening; and
- a concave end able to form a rivet head.

9. Apparatus as claimed in claim 8 in which the body includes a second threaded opening to receive the spinner for storage and in which the spinner has a correspondingly threaded part

10. Apparatus as claimed in claim 8 in which the spinner includes a slot to allow rotation of the spinner in the at least partially threaded opening to form the rivet head.

11. Apparatus as claimed in claim 8 in which the anvil has a pair of openings extending through it;
- a post in the recess to engage an opening to locate the anvil;
- one of the pair of openings being shaped at its outer end to receive a spun rivet head to locate that head while a rivet head is spun on the opposite end of the rivet.

12. Apparatus to remove a rivet from a chain saw chain comprising:
- a body;
- a recess in the body;
- an at least partially threaded opening at one end of the body extending to the recess;
- an anvil to be located in the recess;

a slot in the anvil of predetermined width to contact a saw chain of predetermined pitch;

a bolt to be received in the at least partially threaded opening;

a punch member to be received with a close fit within the at least partially threaded opening to abut the bolt to extend into the recess whereby by tightening of the bolt extends the punch into the recess;

two narrowed ends of differing sizes on the punch member to act as a punch, each to punch out rivets of different sizes; and a recess in the bolt to accommodate the narrowed ends of the punch member.

13. Apparatus to remove a rivet from a chain saw chain comprising:

a body;

a recess in the body;

an at least partially threaded opening at one end of the body extending to the recess;

an anvil to be located in the recess;

a slot in the anvil of predetermined width to contact a saw chain of predetermined pitch;

a bolt to be received in the at least partially threaded opening;

a punch member to be received in the opening to abut the bolt to extend into the recess whereby tightening of the bolt extends the punch into the recess;

a spinner to allow forming of a rivet in a chain saw chain, the spinner comprising a body to be received in the at least partially threaded opening; and a concave end on the spinner able to form a rivet head.

14. Apparatus as claimed in claim 13 in which the body includes a second threaded opening to receive the spinner for storage and in which the spinner has a correspondingly threaded part.

15. Apparatus as claimed in claim 13 in which the spinner includes a slot to allow rotation of the spinner in the at least partially threaded opening to form the rivet head.

16. Apparatus as claimed in claim 13 in which the anvil has a pair of openings extending through it;

a post in the recess to engage an opening to locate the anvil;

one of the pair of openings being shaped at its outer end to receive a spun rivet head to locate the head while a rivet head is spun on the opposite end of the rivet.

* * * * *